US005788815A

United States Patent [19]

Norell et al.

[11] Patent Number: 5,788,815

[45] Date of Patent: Aug. 4, 1998

[54] PROCESS FOR THE PRODUCTION OF PAPER

[75] Inventors: Maria Norell, Hovås; Lennart Nilsson, Kungälv, both of Sweden

[73] Assignee: Eka Chemicals AB, Bohus, Sweden

[21] Appl. No.: 765,731

[22] PCT Filed: May 7, 1996

[86] PCT No.: PCT/SE96/00595

§ 371 Date: Jan. 8, 1997

§ 102(e) Date: Jan. 8, 1997

[87] PCT Pub. No.: WO96/35838

PCT Pub. Date: Nov. 14, 1996

[30] Foreign Application Priority Data

May 12, 1995 [SE] Sweden ..... 95017965

[51] Int. Cl.[6] ..... D21F 1/66

[52] U.S. Cl. ..... 162/190; 162/189; 210/767; 204/554

[58] Field of Search ..... 162/189, 190; 210/777, 767, 695; 204/554, 555, 556, 557, 558, 660, 664, 665

[56] References Cited

U.S. PATENT DOCUMENTS

| | | | |
|---|---|---|---|
| 3,141,816 | 7/1964 | Manley et al. | 162/190 |
| 3,715,305 | 2/1973 | Carnes et al. | 210/695 |
| 3,884,755 | 5/1975 | Frost, III | 162/189 |
| 4,221,634 | 9/1980 | Frost, III | 162/190 |
| 4,388,150 | 6/1983 | Sunden et al. | 162/175 |
| 4,913,775 | 4/1990 | Langley et al. | 162/164.3 |
| 4,961,825 | 10/1990 | Andersson et al. | 162/175 |
| 4,980,025 | 12/1990 | Andersson et al. | 162/168.3 |
| 5,127,994 | 7/1992 | Johansson et al. | 162/168.3 |
| 5,368,833 | 11/1994 | Johansson et al. | 423/338 |
| 5,449,437 | 9/1995 | Vikio | 162/190 |

*Primary Examiner*—Stanley S. Silverman

*Assistant Examiner*—Jose A. Fortuna

*Attorney, Agent, or Firm*—Ralph J. Mancini; Louis A. Morris

[57] ABSTRACT

A process for the production of paper by mixing an aqueous phase comprising white water with cellulose containing fibres, and optional fillers, in a mixing stage to form an aqueous suspension, draining the suspension in the presence of a drainage or retention aid to form a fibre containing sheet or web and white water, and recirculating at least part of the white water to the mixing stage, whereby at least part of the white water is subject to electrodialysis before the mixing stage.

10 Claims, No Drawings

PROCESS FOR THE PRODUCTION OF PAPER

This application is a 371 of PCT/SE96/00595 filed on May 7, 1996.

BACKGROUND OF THE INVENTION

1. Field of the Invention

The present invention relates to a process for the production of paper in which an aqueous suspension of cellulose containing fibres is drained in the presence of a drainage or retention aid and white water is recirculated to the production process. More specifically, the invention relates to a process in which white water is subjected to electrodialysis before being returned to the process, thereby improving drainage and retention.

A wide variety of drainage and retention aids are known in the art. These additives are included in the papermaking stock in order to facilitate drainage and/or to increase adsorption of fine particles and additives onto the cellulose fibres so that they are retained with the fibres. The drainage and retention aids employed include natural and synthetic organic polymers, inorganic materials and many combinations thereof. Usually, oppositely charged materials are used. As examples of commonly used drainage and retention aids can be mentioned cationic starch in combination with colloidal silicic acid, such as for example disclosed in EP 41056, and synthetic cationic polymers in combination with bentonite, such as for example disclosed in EP 235893. These processes and systems have been commercialized under the trade names Compozil™ and Hydrocol™, respectively.

Drainage of papermaking stocks produces cellulose fibre containing sheets or web-like products and white water. The white water, or back water, normally contains non-retained fibre remnants, electrolytes, fillers, etc., and is usually recirculated, either completely or partially, in different flow circuits. In the primary circuit, normally, white water obtained in the sheet-forming zone of the wire section is recycled for stock dilution. The primary circuit is usually maintained as closed as possible. The secondary white water circuit, normally, comprises excess water from the wire section as well as suction, press and cleaning water. Fibres and fillers are usually removed from this type of circulating water whereupon the resulting clarified water is returned to the process, for example for chemical preparation, stock preparation and stock dilution.

Electrodialysis involves the transport of ions through ion-selective or ion-exchange membranes from one solution to another under the influence of an electrical potential. Electrodialysis is commonly used for desalination of brackish water for the production of potable water and table salt.

SUMMARY OF THE INVENTION

According to the present invention it has been found that it is possible to improve drainage and retention in the production of paper by subjecting white water that is to be recirculated to electrodialysis. More specifically, the present invention relates to a process for the production of paper which comprises mixing an aqueous phase comprising white water with cellulose containing fibres, and optional fillers, in a mixing stage to form an aqueous suspension, draining the suspension in the presence of a drainage or retention aid to form a fibre containing sheet or web and white water, recirculating at least part of the white water to the mixing stage wherein at least part of the white water is subjected to electrodialysis before the mixing stage.

DETAILED DESCRIPTION OF THE INVENTION

The present invention results in a considerably improved retention and dewatering in papermaking and makes it possible to enhance the efficiency of drainage or retention aids used. This means that the speed of the paper machine can be increased and that substantially lower dosages of drainage or retention aids can be used to give a corresponding effect, thereby leading to an improved papermaking process in terms of productivity, runnability, paper quality as well as waste reduction. With more efficient retention and dewatering also formation and strength of the paper can be improved.

The term "white water" used herein is meant to include any aqueous phase obtained by draining or dewatering an aqueous suspension or sheet or web-like product of cellulose containing fibres. Usually, the white water is obtained by draining a fibre containing suspension or web in the production of paper. Such white water may contain any of the components fibre remnants, fines, fillers, electrolytes, dyestuffs, sizes, etc., depending on the type of paper produced. The white water can also be obtained by draining a fibre-containing suspension or web or aqueous pulp in the production of pulp or pulp sheets, for example on a pulp-drying machine or a wet machine. Such white water normally contains fibre remnants and electrolytes. Suitably, the white water is obtained in the production of paper, for example by draining the suspension or stock on a wire, by draining the fibre containing web formed by means of further draining operations in the production, for example by pressing and drying the web, and by cleaning the wire and felt, and thus it may contain suction water, press water, cleaning water, etc.

In addition to being subjected to electrodialysis, the white water can be treated by means of any purification step, for example any of those commonly used such as precipitation, sedimentation, flotation and filtration. Such purification, suitably, is carried out prior to electrodialysis in order that particulate, colloidal and/or dissolved organic and/or inorganic material can be removed from the white water, thereby conferring beneficial effects on the electrodialysis treatment in terms of reduced tendency of membrane clogging and increased energy efficiency. Thus, the white water to be electrodialyzed can be withdrawn from the save-all system in the long circulation, e.g. after polydisc filters, flotation cells, sedimentation units, etc., or at any other position where it is convenient to withdraw at least part of the water flow. According to a preferred embodiment of the invention, the white water to be electrodialyzed is withdrawn from the secondary white water circuit. Alternatively or additionally, the white water can be withdrawn from the primary white water circuit, and also from the tertiary white water circuit, then preferably after purification.

By the term "electrodialysis" used herein is meant any electrochemical process including at least one ion-selective or ion-exchange membrane. The fundamentals of electrodialysis have been described in the prior art, for example by R. W. Baker et al, Membrane Separation Systems, Noyes Data Corp., 1991, which is hereby incorporated herein by reference.

Electrodialysis treatment of white water can be carried out by means of an electrodialysis device containing at least one unit cell arranged between a cathode and an anode. Commercially available devices, unit cells and membranes can be used, such as for example those described by Baker et al referred to herein. According to a preferred embodiment of the invention, the unit cell comprises at least one compartment having an anion selective membrane towards the anode side of the cell and a cation selective membrane towards the cathode side of the cell, whereby the white water is fed to and suitably passed through said compartment. By establishing an electrical potential between the anode and the cathode, the white water is subjected to electrodialysis. The unit cell may comprise one anion selective membrane, one cation selective membrane and two compartments, one of them formed between the membranes and thus being the white water feed compartment, and the other compartment adjacent thereto. In the adjacent compartment a flow of an aqueos solution of a salt, e.g. NaCl, can be circulated.

The unit cells are suitably stacked to form an electrodialysis stack containing a number of alternating anion and cation selective membranes with solution compartments between them. The unit cells and stacks can be connected in series or sequence or in parallel. According to a preferred embodiment of the invention, white water is fed through a sequence of unit cells and the current density applied is decreasing in said sequence, whereby the current efficiency can be optimized. According to another preferred embodiment of the invention, the electrodialysis treatment is run batchwise in a constant voltage mode, whereby the current density is allowed to drop during the treatment in parallel to concentration decrease in the white water. In the electrodialysis treatment, the current density can be within the range of from 0.005 to 10 $kA/m^2$, preferably from 0.020 to 3 $kA/m^2$.

According to the present invention, the white water, or back water, can be completely or partially reused in the process. The electrodialyzed white water that is to be returned to the process as described herein can be a mixture containing white water and fresh water, where the proportion of white water to fresh water mainly will be determined by the required amount of water that is to be supplied to the process. The amount of white water to be treated by electrodialysis may vary from mill to mill depending on, among other things, the raw material used, the origin of the white water, the degree of mill closure and the desired effect. Of course, the amount of white water to be treated by electrodialysis is preferably chosen so as to provide a cost-efficient papermaking process balancing the benefits offered by the treatment and the cost of the process. In each case the amount can be determined by laboratory tests of the type described in the examples herein. The amount of white water to be treated by electrodialysis can for example be at least 0.25% and in many cases it is at least 0.5% by weight of the white water recirculated, the upper limit being 100% by weight. The invention is preferably applied to paper mills where white water is extensively recirculated and only low amounts of fresh water are introduced into the process. Suitably, less than 50, preferably less than 30 and most preferably 0–15 tons of fresh water are used per ton of paper produced. It is thus preferred that the mill is substantially entirely closed.

Returning white water to a papermaking process is conventional and electrodialyzed white water produced according to the present invention can be returned correspondingly. The white water can be returned at any stage of the papermaking process. For instance, the white water can be mixed with cellulose containing fibres for preparing the aqueous suspension or stock, and it can be mixed with dried pulp in order to form a thick stock. Further, the white water can be mixed with drained pulp to dilute the pulp so as to form the thick stock, for example in an integrated mill. A preferred aspect of the invention comprises mixing white water with cellulose-containing fibres for diluting the aqueous suspension. Thus, the white water can be added for diluting the thick stock so as to form a thin stock. The white water can of course also be returned to the process by being utilized in the preparation of solutions and dispersions of chemicals to be used in the process. In addition, the white water can be returned as wire spray water, trim squirt water, roll moisturing water, pump seal water, etc.

The present invention comprises dewatering an aqueous suspension of cellulose containing fibres, and optional filler, in the presence of a drainage or retention aid, suitably on a wire. The drainage or retention aid can of course comprise more that one material, for example it can be a system of drainage or retention aids comprising two, three, four or more materials. The addition of the aid or aids to the suspension in order to improve drainage and/or retention can be made in conventional manner. Any drainage or retention aid known in the art can be used, and it can be selected from the groups inorganic materials, organic materials and mixtures thereof. Suitably, mixtures of the materials mentioned are used, in particular at least one cationic material in combination with at least one anionic material. The inorganic material is suitably anionic. Suitable inorganic materials can be selected from silica based particles, clays of the smectite type, titanyl sulphate sols, aluminium compounds, and mixtures thereof.

Silica based particles, i.e. particles based on $SiO_2$, including colloidal silica, colloidal aluminium-modified silica, aluminium silicates, different types of polysilicic acid (microgel) and mixtures thereof, are known in the art.

Clays of the smectite type are known in the art and include naturally occurring, synthetic and chemically treated materials. As examples of suitable smectite clays can be mentioned montmorillonite/bentonite, hectorite, beidelite, nontronite and saponite.

The use of aluminium compounds for improving drainage and/or retention in papermaking is well known in the art. Examples of suitable aluminium compounds include alum, aluminates, aluminium chloride, aluminium nitrate and polyaluminium compounds, such as polyaluminium chlorides, polyaluminium sulphates, polyaluminium compounds containing both chloride and sulphate ions, and mixtures thereof.

Organic materials useful as drainage and/or retention aids are well known in the art. They can be selected from anionic, amphoteric, nonionic and cationic polymers, and mixtures thereof. The polymers can be natural, i.e. based on carbohydrates, or synthetic, and they can be linear, branched and/or in the form of micro-particles. As examples of suitable polymers can be mentioned anionic, amphoteric and cationic starches, guar gums, chitosans and acrylamide-based polymers, as well as polyethylene imines, polyamines, polyamidoamines and poly(diallyldimethyl ammonium chloride).

Suitably, use is made of a system of drainage and/or retention aids comprising silica based particles and at least one polymer selected from anionic, amphoteric, nonionic and cationic polymers, and mixtures thereof, e.g. an amphoteric or cationic polymer, or anionic and cationic polymers, preferably at least one amphoteric or cationic polymer.

The amount of drainage or retention aid used can vary within wide limits depending on, among other things, type and number of materials, type of suspension, presence of fillers and other conditions. When using an inorganic material as a drainage or retention aid, the amount is usually at least 0.001% by weight, often at least 0.005% by weight, based on dry substance of the stock. The upper limit is usually 1.0% and suitably 0.6% by weight. When silica based particles are used, the amount is suitably within the range of from 0.005 to 0.5% by weight, calculated as $SiO_2$ on dry stock substance, preferably within the range of from 0.01 to 0.2% by weight. When using an organic material, the amount is usually at least 0.001%, often at least 0.005% by weight, based on dry substance. The upper limit is usually 3% and suitably 1.5% by weight.

The process according to the present invention can be used for producing cellulose fibre containing products in sheet or web form such as for example pulp sheets and paper. It is preferred that the present process is used for the production of paper. The term "paper" as used herein of course include not only paper and the production thereof, but also other sheet or web-like products, such as for example board and paperboard, and the production thereof.

The process according to the invention can be used in the production of sheet or web-like products from different types of suspensions of cellulose containing fibres and the suspensions should suitably contain at least 50% by weight of such fibres, based on dry substance. The suspensions can be based on fibres from chemical pulp, such as sulphate and sulphite pulp, thermomechanical pulp, chemo-thermomechanical pulp, organosolv pulp, refiner pulp or groundwood pulp from both hardwood and softwood, and can also be used for suspensions based on recycled fibres. The suspension can also contain mineral fillers of conventional types, such as for example kaolin, titanium dioxide, gypsum, talc and both natural and synthetic calcium carbonates. The stock can of course also contain papermaking additives of conventional types, such as wet-strength agents, stock sizes based on rosin, ketene dimers or alkenyl succinic anhydrides, etc. The present invention makes it possible to improve the retention of such additives, which means that further benefits can be obtained, for example improved sizing and wet strength of the paper.

The invention is further illustrated in the following Examples which, however, are not intended to limit the same. Parts and % relate to parts by weight and % by weight, respectively, unless otherwise stated.

EXAMPLE 1

Clarified white water from a closed board mill using recycled fibres was treated with polyacrylamide, 10 mg/l, and filtrated. The white water filtrate obtained was fed to an electrodialysis device containing 10 unit cells. The effective electrode area was 0.0172 $m^2$ and each unit cell contained one anion selective membrane and one cation selective membrane. The filtrate was fed into the compartments having an anion selective membrane towards the anode side of the cell and a cation selective membrane towards the cathode side of the cell. In the adjacent compartments a flow of NaCl brine, 30 g/l, was circulated. The electrodes were separated with cation selective membranes and an electrode rinse solution containing 50 g/l of $Na_2SO_4$ was passed through these electrode compartments. All flows were 250 l/hour. The cell was operated at a current density of 100 $A/m^2$ during 1 hour and 20 minutes.

EXAMPLE 2

Clarified white water was evaluated by measuring the fines retention of a stock prepared from electrodialysis (ED) treated white water according to Example 1 and a comparison was made with a stock prepared from clarified white water that was not electrodialysis treated (untreated). The stocks were based on pulp with a composition of 35% of sulphate pulp, 35% of a mixture of stoneground wood and thermomechanical pulps and 30% of broke, to which 0.3 g/l of $Na_2SO_4.10H_2O$ had been added. The stocks had a pH of 5.5, a dry solids concentration of 0.5% and a fine fraction content of 37%.

The retention was determined by means of a Britt Dynamic Drainage Jar at 1000 rpm. This is the conventional test method for retention in the paper industry. A retention and drainage system was used comprising a cationic polyacrylamide and anionic silica based particles, whereby the polymer was added to the stock before the silica based particles. The amounts of cationic polyacrylamide (C-PAM) and silica based particles ($SiO_2$) shown in Table I are calculated as dry on dry substance of the stock.

TABLE I

| Test No. | C-PAM kg/ton | $SiO_2$ kg/ton | Fines retention untreated (%) | Fines retention ED-treated (%) |
|---|---|---|---|---|
| 1 | — | — | 46.0 | 46.0 |
| 2 | 0.3 | 1.0 | 47.0 | 56.5 |
| 3 | 0.5 | 1.0 | 48.0 | 57.8 |
| 4 | 0.9 | 1.0 | 56.0 | 60.9 |

As is evident from Table I, the use of electrodialysis treated white water resulted in a considerably improved retention effect.

EXAMPLE 3

In this Example, stocks prepared from clarified white water that was electrodialyzed (ED-treated) and non-electrodialyzed (untreated), respectively, were evaluated in a manner similar to Example 2, except that a cationic starch (C-Starch) was used instead of cationic polyacrylamide.

TABLE II

| Test No. | C-Starch kg/ton | $SiO_2$ kg/ton | Fines retention untreated (%) | Fines retention ED-treated (%) |
|---|---|---|---|---|
| 1 | — | — | 46 | 46 |
| 2 | 10 | 1.5 | 46 | 54.8 |
| 3 | 20 | 1.5 | 50 | 54.1 |
| 4 | 30 | 1.5 | 52 | 57.5 |

The process according to the present invention using electrodialysis treated white water gave a substantial improvement of the retention effect.

We claim:

1. A process for the production of paper which comprises mixing an aqueous phase comprising cellulose containing fibers, and optional fillers, in a mixing stage to form an aqueous suspension, draining the suspension in the presence of a drainage or retention aid to form a fiber containing sheet or web and white water, and recirculating at least part of the white water to the mixing stage, wherein at least part of the white-water which is recycled is subjected to electrodialysis before the mixing stage.

2. The process of claim 1 wherein the electrodialysis is carried out in an electrodialysis device containing at least one unit cell arranged between a cathode and an anode, the unit cell comprising at least one compartment having an anion selective membrane towards the anode side of the cell and a cation selective membrane towards the cathode side of the cell, and whereby the white water is fed to said compartment.

3. The process of claim 1, wherein the recycled white water is mixed with cellulose containing fibers for preparing the aqueous suspension.

4. The process of claim 1 further comprising diluting said aqueous suspension with recycled white water comprising cellulose containing fibers.

5. The process of claim 1 wherein at least part of said recycled white water which is subjected to electrodialysis, is purified by precipitation, sedimentation, flotation or filtration before being subjected to electrodialysis.

6. The process of claim 1 wherein the drainage or retention aid comprises an inorganic material selected from the group consisting of silica based particles, clays of the smectite type, titanyl sulphate sols, and aluminum compounds.

7. The process of claim 6 wherein the silica based particles are selected from colloidal silica, colloidal aluminum-modified silica, aluminum silicates, polysilicic acid and mixtures thereof.

8. The process of claim 1 wherein the drainage or retention aid comprises an organic material selected from anionic polymers, amphoteric polymers, nonionic polymers and cationic polymers.

9. The process of claim 1 wherein the retention or drainage aid comprises silica based particles and a cationic or amphoteric polymer.

10. The process of claim 9 wherein the silica based particles are selected from colloidal silica, colloidal aluminum-modified silica, aluminum silicates, polysilicic acid and mixtures thereof.

* * * * *